US008561436B2

(12) United States Patent
Lin

(10) Patent No.: US 8,561,436 B2
(45) Date of Patent: Oct. 22, 2013

(54) DIRECT DRIVING AUXILIARY YARN GUIDE APPARATUS FOR FLAT KNITTING MACHINES

(75) Inventor: Yu-Sheng Lin, New Taipei (TW)

(73) Assignee: Pai Lung Machinery Mill Co., Ltd., New Taipei (TW)

( * ) Notice: Subject to any disclaimer, the term of this patent is extended or adjusted under 35 U.S.C. 154(b) by 157 days.

(21) Appl. No.: 13/204,920

(22) Filed: Aug. 8, 2011

(65) Prior Publication Data

US 2013/0036771 A1 Feb. 14, 2013

(51) Int. Cl.
*D04B 15/48* (2006.01)

(52) U.S. Cl.
USPC ..... 66/132 R

(58) Field of Classification Search
USPC ..... 66/125 R, 126 R, 132 R, 141, 146
See application file for complete search history.

(56) References Cited

U.S. PATENT DOCUMENTS 2,199,263 A * 4/1940 Lawson ..... 66/132 R
2,327,747 A * 8/1943 Sirmay ..... 66/210
3,083,924 A * 4/1963 Vossen et al. ..... 242/364.9
3,194,276 A * 7/1965 Krukonis et al. ..... 139/452
4,109,491 A * 8/1978 Schmid et al. ..... 66/125 R
4,287,728 A * 9/1981 Schmid et al. ..... 66/125 R
4,338,799 A * 7/1982 Eberwein et al. ..... 66/125 R
4,526,019 A * 7/1985 Betts et al. ..... 66/132 R
4,706,476 A * 11/1987 Memminger et al. ..... 66/132 R
4,724,687 A * 2/1988 Gariboldi et al. ..... 66/125 R

* cited by examiner

*Primary Examiner* — Danny Worrell

(74) *Attorney, Agent, or Firm* — Muncy, Geissler, Olds & Lowe, PLLC

(57) ABSTRACT

A direct driving auxiliary yarn guide apparatus for a flat knitting machine which includes a chassis, a needle bar on the chassis, a slide track above the needle bar, a yarn feeder slidably mounted onto the slide track and a yarn delivery device. The auxiliary yarn guide apparatus includes a motor located on the chassis that is coupled with a spindle and a plurality of yarn guide wheels mounted on the spindle. The motor drives the spindle and the yarn guide wheels spinning to guide yarns via the yarn delivery device to the yarn feeder to be knitted through the needle bar. Thereby yarn guiding stability improves and quality of knitting products also is enhanced.

6 Claims, 4 Drawing Sheets

DIRECT DRIVING AUXILIARY YARN GUIDE APPARATUS FOR FLAT KNITTING MACHINES

FIELD OF THE INVENTION

The present invention relates to a direct driving auxiliary yarn guide apparatus for flat knitting machines and particularly to a direct driving auxiliary yarn guide apparatus for flat knitting machines to aid yarn guiding.

BACKGROUND OF THE INVENTION

Flat knitting machines mainly are designed to knit textile products to make knitting clothes. Their practicality greatly impacts people's life.

A conventional flat knitting machine mainly includes a chassis, a needle bar located on the chassis, a slide track above the needle bar and a yarn feeder slidably located on the slide track. An auxiliary yarn guide apparatus and a yarn delivery device are provides at each of two sides of the chassis. Yarns pass through, in this order, a yarn rack above the chassis, the auxiliary yarn guide apparatus and yarn delivery device, and are sent to the yarn feeder slid reciprocally on the track to be knitted on the needle bar.

The auxiliary yarn guide apparatus mainly aims to offset frictional forces of the yarns generated during winding through the yarn rack to smooth yarn delivery. The auxiliary yarn guide apparatus mainly includes a motor, a belt, a belt pulley, a spindle and a yarn guide wheel. When the motor is in operation it drives the yarn guide wheel mounted on a spindle to spin via the belt and belt pulley to aid yarn guide function.

However, when the auxiliary yarn guide apparatus is used for a prolonged period of time the belt tends to fatigue or wear off, and cannot effectively drive the yarn guide wheel spinning, and results in unstable yarn guiding. Moreover, the auxiliary yarn guide apparatus is complicated and consists of too many elements, assembly and installation are difficult and time-consuming, repairs and maintenance and replacement of the elements also are difficult, there is room for improvement.

SUMMARY OF THE INVENTION

The primary object of the present invention is to solve the problems of the conventional auxiliary yarn guide apparatus of unstable yarn guiding and too many elements and difficult for assembly and installation.

To achieve the foregoing object the present invention provides a direct driving auxiliary yarn guide apparatus for a flat knitting machine. The flat knitting machine includes a chassis, a needle bar on the chassis, a slide track above the needle bar, a yarn feeder slidably mounted onto the slide track and a yarn delivery device. Yarns are directed through the auxiliary yarn guide apparatus to the yarn feeder and knitted through the needle bar. The auxiliary yarn guide apparatus includes a motor located on the chassis that is coupled with a spindle and a plurality of yarn guide wheels mounted on the spindle. When the motor is in operation the spindle is driven to drive the yarn guide wheels spinning to guide the yarns to the yarn delivery device to be sent to the yarn feeder.

In an embodiment of the invention the spindle includes a driving shaft extended outwards, a driven shaft running through the yarn guide wheels and a sleeve with two ends coupled on the driving shaft and driven shaft. The driving shaft drives the driven shaft spinning through the sleeve.

The auxiliary yarn guide apparatus includes a motor holder located on the chassis to hold the motor. The motor holder has a coupling board fastened to the chassis and a mounting rack located on the coupling board to hold the motor. The mounting rack has a panel fastened to the coupling board and a first side plate and a second side plate extended vertically from two ends of the panel. The first and second side plates have respectively an opening run through by the spindle. The motor is fastened to one side plate. Moreover, the mounting rack has an inner cover plate surrounding the spindle and fastened to the panel, and an outer cover plate to bridge the first and second side plates.

In addition, the auxiliary yarn guide apparatus further includes a yarn guide plate fastened to the motor holder. The yarn guide plate has a plurality of apertures threaded through by the yarns. The spindle has a distal end coupled with a bearing. A support rack is provided to hold the bearing and yarn guide plate.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
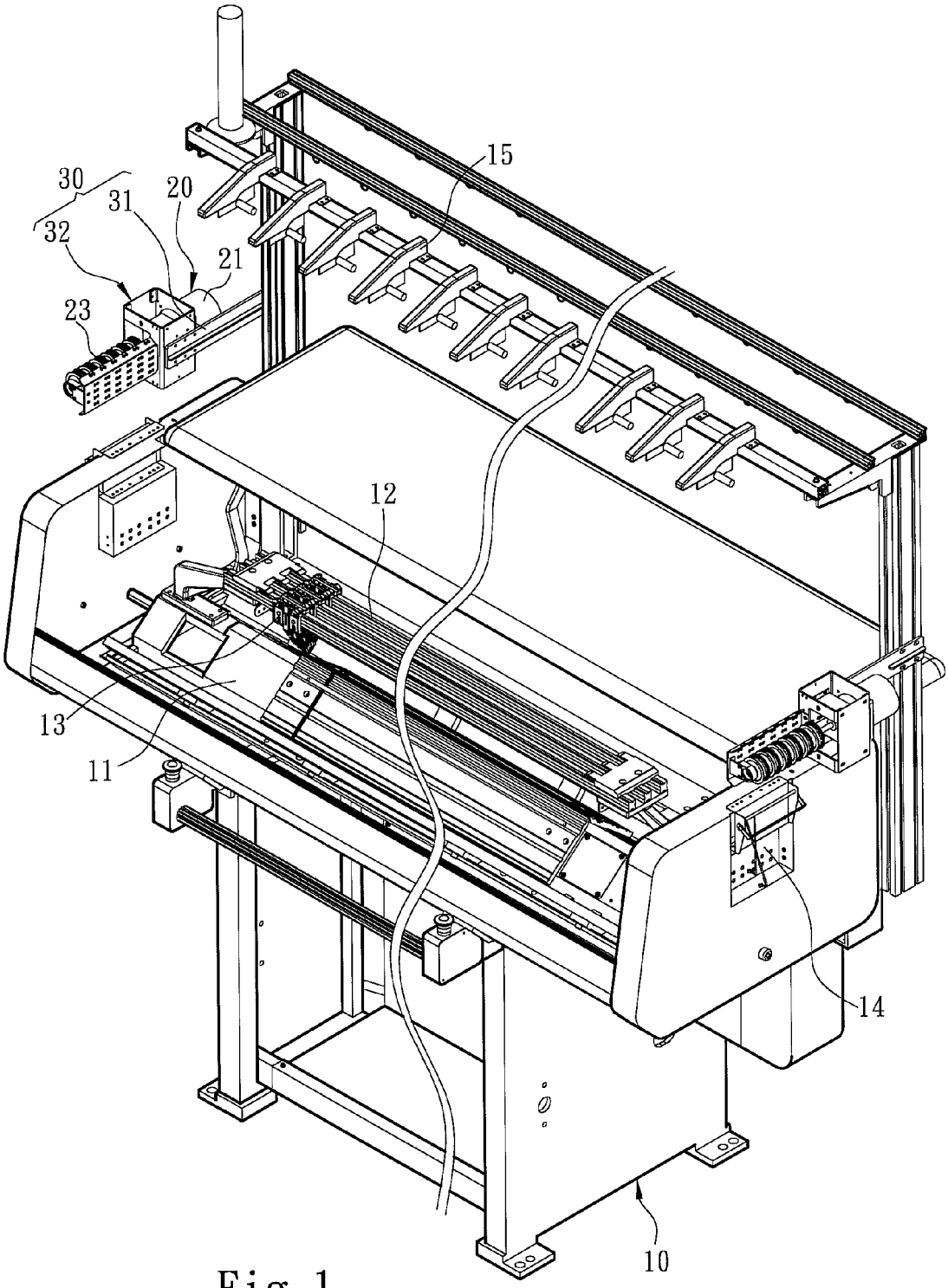
FIG. 1 is an overall perspective view of the invention.

Please referring to FIG. 1, the present invention aims to provide a direct driving auxiliary yarn guide apparatus for a flat knitting machine. The flat knitting machine manly includes a chassis 10, a needle bar 11 on the chassis 10, a slide track 12 above the needle bar 11, a yarn feeder 13 slidably mounted onto the slide track 12 and a yarn delivery device 14. Yarns are directed through the auxiliary yarn guide apparatus 20 to the yarn feeder 13 via the yarn delivery device 14 and knitted through the needle bar 11.

Figure 2:
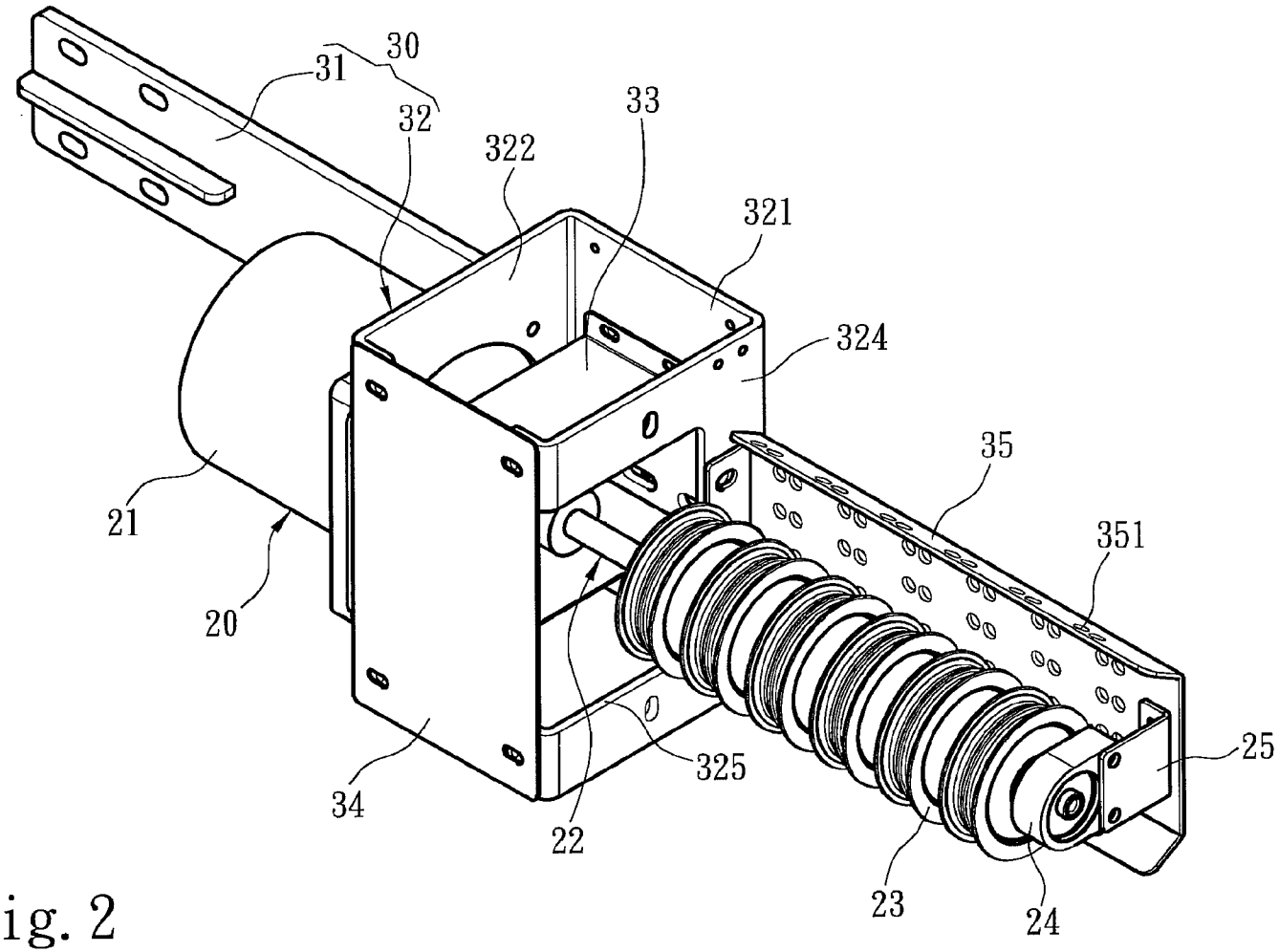
FIG. 2 is a fragmentary perspective view of the invention.
Figure 3:
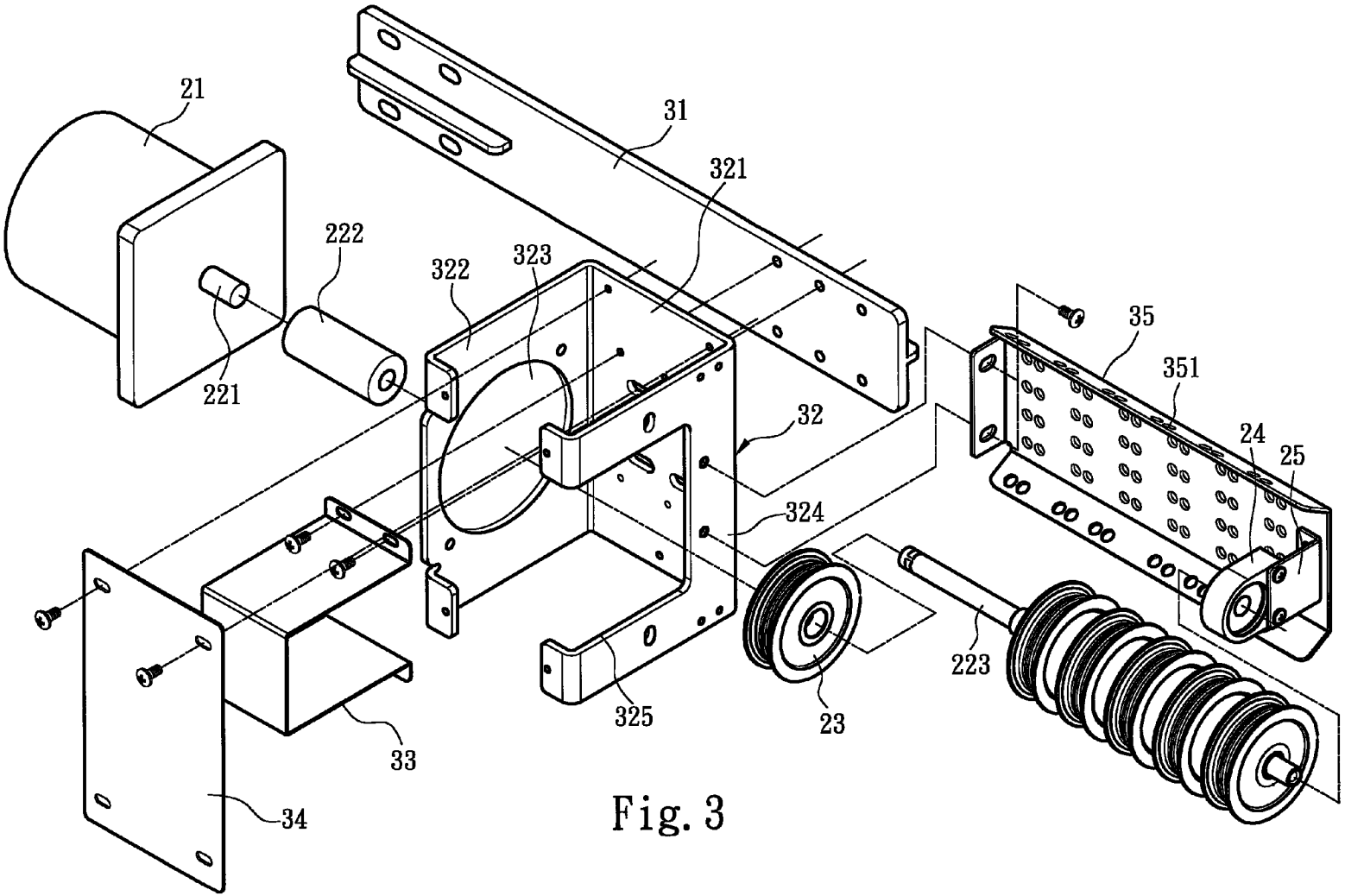
FIG. 3 is an exploded view of the auxiliary yarn guide apparatus of the invention.

Also referring to FIGS. 2 and 3, the auxiliary yarn guide apparatus 20 includes a motor 21 which has one end coupled with a spindle 22. The spindle 22 has a plurality of yarn guide wheels 23 mounted thereon. The spindle 22 includes a driving shaft 221 extended outwards from the motor 21, a driven shaft 223 running through the yarn guide wheels 23 and a sleeve 222 with two ends coupled on the driving shaft 221 and driven shaft 223. When the motor 21 is in operation the driving shaft 221 drives the driven shaft 223 through the sleeve 222 to drive the yarn guide wheels 23 spinning.

Moreover, the auxiliary yarn guide apparatus 20 also includes a motor holder 30 located on the chassis 10 to hold the motor 21. The motor holder 30 has a coupling board 31 fastened to the chassis 10 and a mounting rack 32 fastened to the coupling board 31 to hold the motor 21. In an embodiment of the invention the mounting rack 32 has a panel 321 fastened to the coupling board 31 and a first side plate 322 and a second side plate 324 extended vertically from two ends of the panel 321. The motor 21 is fastened to one side plate, as shown in the drawings, to the first side plate 322 in this embodiment. The first and second side plates 322 and 324 have respectively an opening 323 and 325 run through by the spindle 22. Moreover, the mounting rack 32 has an inner cover plate 33 located between the first and second side plates 322 and 324 and fastened to the panel 321. The inner cover plate 33 is formed in a U shape to surround the sleeve 222. The mounting rack 32 further has an outer cover plate 34 to bridge the first and second side plates 322 and 324 to prevent the sleeve 222 from loosening away caused by external articles that might create a problem of unable to drive the yarn guide wheels 23 by the motor 21.

The auxiliary yarn guide apparatus 20 further includes a yarn guide plate 35 fastened to the second side plate 324. The yarn guide plate 35 has a plurality of apertures 351 threaded through by the yarns. The spindle 22 has a distal end coupled with a bearing 24 and a support rack 25 to hold the bearing 24 and yarn guide plate 35, thus forms the main structure of the invention.

Figure 4:
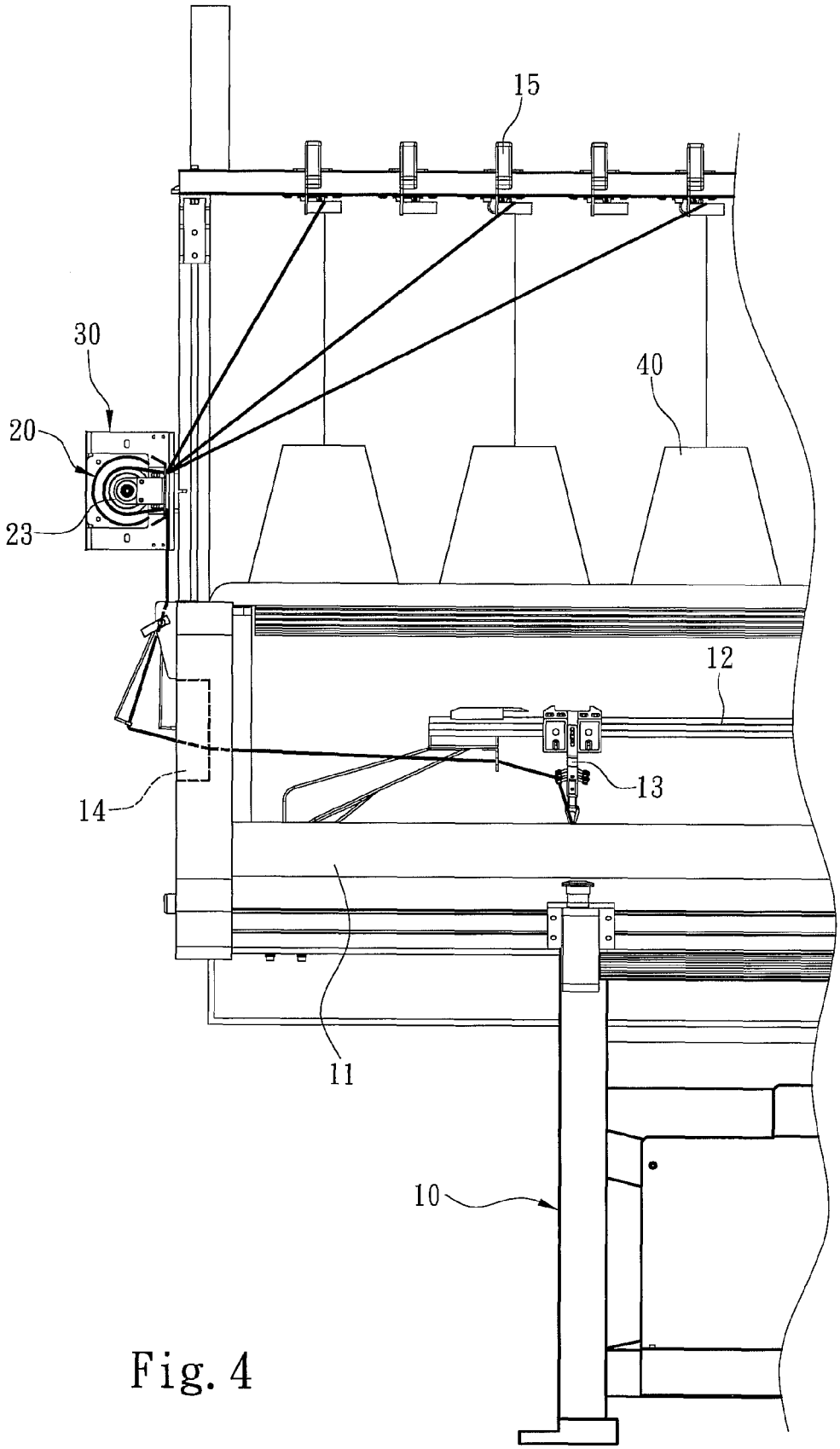
FIG. 4 is a schematic view of yarn guiding according to the invention.

Referring to FIG. 4, when the flat knitting machine is in operation a yarn from a yarn spool 40 passes through a yarn bracket 15 and is drawn to an outer side of the chassis 10, and winds around one yarn guide wheel 23 of the auxiliary yarn guide apparatus 20, then is sent to the yarn feeder 13 via the yarn delivery device 14. Because the yarn passes through the yarn bracket 15 in a bending manner, a frictional force is generated that could reduce stability and quality of knitting operation. The auxiliary yarn guide apparatus 20 of the invention provides a buffer to offset the frictional force, thus can make knitting operation smoother.

As a conclusion, the invention provides the auxiliary yarn guide apparatus 20 which mainly includes an independent driving motor 21 to couple with a spindle 22 with a plurality of yarn guide wheels 23 mounted thereon. When the motor 21 is in operation the spindle 22 directly drives the yarn guide wheels 23 spinning, the number of elements required decreases, production, assembly and installation are easier. The direct driving also is more stable.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A direct driving auxiliary yarn guide apparatus for a flat knitting machine, the flat knitting machine including a chassis, a needle bar located on the chassis, a slide track located above the needle bar, a yarn feeder slidably mounted onto the slide track and a yarn delivery device such that yarns are directed by the auxiliary yarn guide apparatus to pass through the yarn delivery device to the yarn feeder and knitted via the needle bar, the auxiliary yarn guide apparatus comprising:

a motor located on the chassis and contained an extended spindle driven by the motor to generate spinning;

a motor holder located on the chassis to hold the motor;

a yarn guide plate fastened to the motor holder, the yarn guide plate including a plurality of apertures threaded through by the yarns, wherein the spindle includes a distal end coupled with a bearing and a support rack coupled with the bearing and the yarn guide plate; and a plurality of yarn guide wheels mounted on the spindle and driven to spin such that the yarn guide wheels draw and direct the yarns to the yarn feeder during spinning.

2. The direct driving auxiliary yarn guide apparatus of claim 1, wherein the spindle includes a driving shaft extended outwards from the motor, a driven shaft running through the yarn guide wheels and a sleeve which includes two ends coupled with the driving shaft and the driven shaft.

3. Thee direct driving auxiliary yarn guide apparatus of claim 2, wherein the motor holder includes a coupling board fastened to the chassis and a mounting rack fastened to the coupling board to hold the motor.

4. The direct driving auxiliary yarn guide apparatus of claim 3, wherein the mounting rack includes a panel fastened to the coupling board and a first side plate and a second side plate extended vertically from two ends of the panel, the motor being fastened to one of the first and second side plates.

5. The direct driving auxiliary yarn guide apparatus of claim 4, wherein the mounting rack includes an inner cover plate surrounded the spindle and fastened to the panel.

6. The direct driving auxiliary yarn guide apparatus of claim 4, wherein the mounting rack further includes an outer cover plate to bridge the first side plate and the second side plate.

* * * * *